United States Patent [19]

Raymond

[11] 4,242,899

[45] Jan. 6, 1981

[54] THERMOCLAMPS

[75] Inventor: Roger S. Raymond, Redondo Beach, Calif.

[73] Assignee: The United States of America as represented by the Secretary of the Air Force, Washington, D.C.

[21] Appl. No.: 17,623

[22] Filed: Mar. 5, 1979

[51] Int. Cl.[3] ..... B21J 1/06

[52] U.S. Cl. ..... 72/342

[58] Field of Search ..... 72/342; 148/130, 131

[56] References Cited

U.S. PATENT DOCUMENTS

| | | | |
|---|---|---|---|
| 3,060,564 | 10/1962 | Corral | 72/342 |
| 3,383,900 | 5/1968 | Van Hartesveldt | 72/342 |
| 3,934,441 | 1/1976 | Hamilton et al. | 72/342 |
| 3,974,673 | 8/1976 | Fosness et al. | 72/342 |

*Primary Examiner*—Lowell A. Larson

*Attorney, Agent, or Firm*—Donald J. Singer; Arsen Tashjian

[57] ABSTRACT

Apparatus for heat flattening and/or forming titanium sheet material under heat and pressure using thermoclamps fabricated of materials having different thermal expansion properties. Upper and lower dies are made of one alloy having a large thermal expansion while tie bars between the two dies are made of an alloy having low thermal expansion. During heat cycles, the difference in expansion causes the tie bars to close the gap between the dies and apply pressure to the titanium sheet between. In an alternate arrangement, the thermal clamping action coins a bead into a diaphragm to make a vacuum tight seal so that the atmospheric pressure in the oven produces the forming or flattening of the sheet.

4 Claims, 2 Drawing Figures

THERMOCLAMPS

STATEMENT OF GOVERNMENT INTEREST

The invention described herein may be manufactured and used by or for the Government for governmental purposes without the payment of any royalty thereon.

BACKGROUND OF THE INVENTION

This invention relates to a thermal clamp for heat forming and/or flattening a titanium sheet and, more particularly, the invention is concerned with providing thermoclamps having parts fabricated of different alloys such that the different coefficients of expansion will operate to apply pressure to the sheet when the clamped fixture is heated.

Heretofore, it has been common practice to heat flatten or form titanium sheets by heating in an oven. There are three variable elements that affect the procedure. These elements are heat, time and pressure. In the production of flattened and formed titanium the heat is limited to the 1200° F. to 1250° F. range so that the recrystallization annealed properties will not be disturbed. The time is limited to about one hour at temperature in the interest of keeping the cost reasonable. Thus, in effect, the only element which is variable is the pressure.

Normally, components of a heat treat fixture are fabricated of the same alloy and the necessary clamping action is accomplished by wedges which are driven into slots to apply pressure. These wedges loosen up during the heating cycle requiring the fixture to be removed from the oven at peak temperature. The wedges must then be redriven and the heat treat fixture reinserted into the oven for the balance of the cycle. Thus, it can be seen that, presently, the production of flat recrystallization annealed titanium is dependent upon wedge activated clamps which loosen up during the hot sizing and forming operation in the fixture run in the oven. Also, the inability of titanium producers to supply flat recrystallization annealed conditioned 5A1-4V titanium forces airframe builders to purchase excess on each side of a plate and machine it flat. In certain cases such as, for example the B1 bomber, this excess can amount to 6200 pounds per aircraft.

SUMMARY OF THE INVENTION

The present invention is concerned with providing an apparatus for heat flattening and/or forming titanium sheet material under heat and pressure using bi-metal fixtures fabricated of two different alloys. One of the alloys has a large thermal expansion and is used in the fabrication of the upper and lower dies. The other alloy has a low thermal expansion and is used for producing tie bars disposed between the upper and lower dies. During the heat cycles, the tie bars close the gap between the upper and lower dies and thus apply pressure. The amount of movement depends upon the differential expansion of the two alloys and the distance between the attach points on the upper and lower dies. In an alternative embodiment, the thermal clamping action coins a bead into a diaphragm to make a vacuum tight seal. Heat forming or flattening is then accomplished with atmospheric pressure in the oven.

Accordingly, it is an object of the invention to provide an apparatus for heat flattening recrystallization annealed titanium or the like by clamping the workpiece in a bi-metal fixture and applying heat causing the fixture to apply pressure to the workpiece.

Another object of the invention is to provide a thermoclamp fixture including an upper die, a lower die and a series of tie bars therebetween. The upper and lower dies are fabricated of an alloy having a large thermal expansion while the tie bars are produced of an alloy having a low thermal expansion.

Still another object of the invention is to provide a bi-metal fixture wherein heat and pressure can be applied to a titanium plate positioned therein to flatten and/or form the plate without removing the fixture from the oven for retightening thereby allowing the operation to be carried out in a single operation.

A further object of the invention is to provide a vacuum operated thermoclamp suitable for forming a titanium plate to the desired shape wherein the thermal clamping action coins a bead into a diaphragm to make a vacuum tight seal. Heat forming or flattening is then accomplished with atmospheric pressure in the oven.

These and other objects, features and advantages will become more apparent after considering the following detailed description taken in conjunction with the annexed drawing and appended claims.

DESCRIPTION OF A PREFERRED EMBODIMENT

Figure 1:
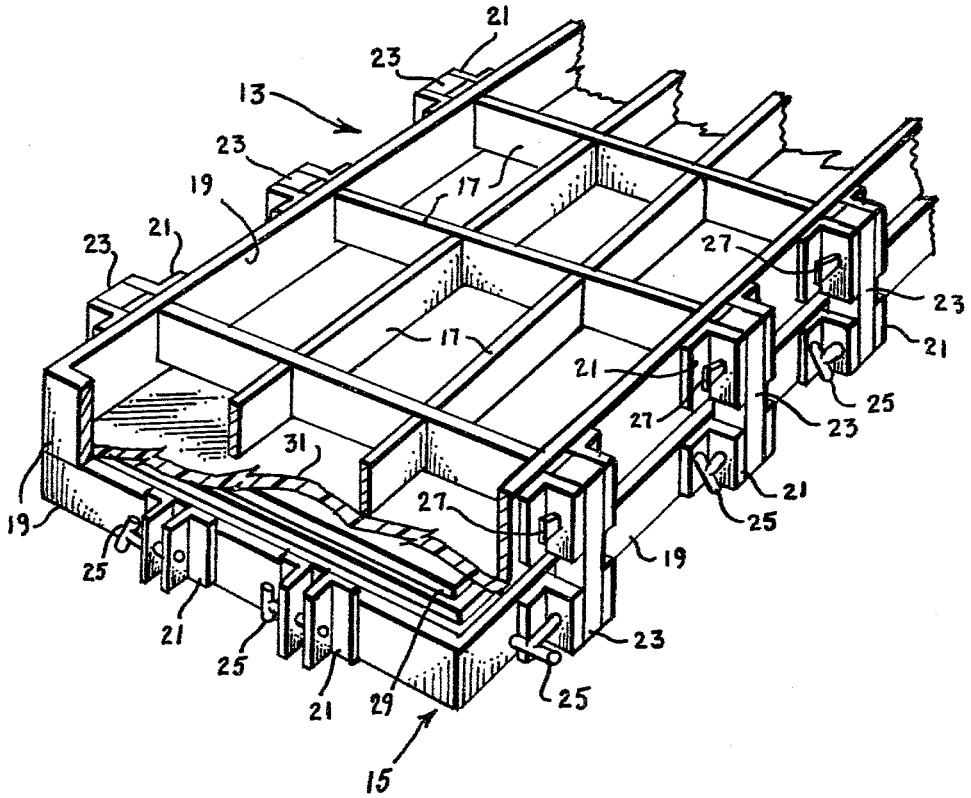
FIG. 1 is a view in perspective partially cut away of a thermoclamp according to the invention showing the upper and lower dies manufactured of one alloy and the tie bars manufactured of a different alloy.

Referring now to the drawings in which like reference numerals refer to the same elements in the two views, there is shown a thermoclamp including an upper die 13 and a lower die 15. Both the upper die 13 and the lower die 15 are of the "egg crate" type and include a plurality of cross members 17 between outer frame members 19 to act as stiffeners while the thermoclamp is under heat and pressure. The upper and lower dies 13 and 15, respectively, are fabricated of an alloy having a large thermal expansion. Fixedly attached at spaced intervals along the outside surface of the outer frame members 19 are a series of pairs of right angle pieces 21. Each pair 21 includes a space between the parallel sides for accepting a tie bar 23. The paired pieces 21 on the upper and lower dies 13 and 15 are in alignment so that each of the tie bars 23 is effectively positioned between the parallel sides of the pieces 21.

The pairs of right angle pieces 21 attached to the lower die 15 are provided with aligned circular openings horizontally oriented to accept a circular pin 25. The tie bar 23 also includes a circular opening in its lower portion to accept the pin 25. The pairs of right angle pieces 21 attached to the upper die are provided with aligned vertically oriented rectangular slots to accept a wedge 27. The tie bar 23 also includes a rectangular slot in its upper portion to accept the wedge 27. The tie bars 23 are substantially square in cross section and long enough to reach from the bottom surface of the lower die 15 to the top surface of the upper die 13.

Figure 2:
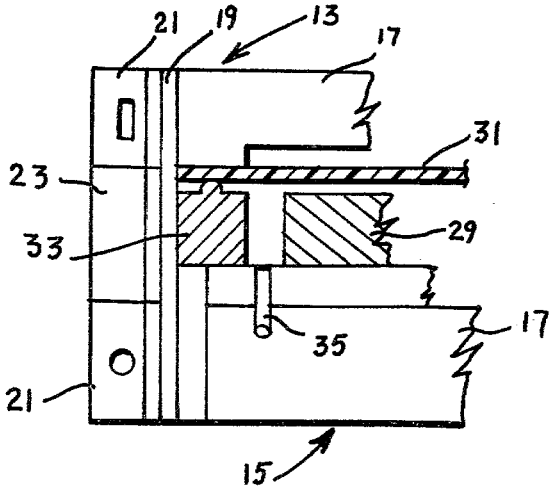
FIG. 2 is an end view in partial cross section of one corner in detail of the thermoclamp of FIG. 1 showing the vacuum line and diaphragm arrangement.

The workpiece 29 is positioned on top of the upper surface of the lower die 15. A diaphragm 31 is positioned over the workpiece 29 with the outer edges of the diaphragm 31 in contact with a seal bead 33 (shown in FIG. 2). The outer edges of the upper die 13 rest on the upper surface of the diaphragm 31 over the seal bead 33. A vacuum line 35 in the lower die 15 is positioned to draw the air from the area between the diaphragm 31 and the workpiece 29.

In operation, the workpiece 29 is placed on top of the lower die 15. The diaphragm 31 is placed over the workpiece 29 with the outer edges of the diaphragm 31 in contact with the seal bead 33. The upper die 13 is then placed over the lower die 15 so that each of the pairs of right angle pieces 21 is in alignment with its corresponding pair. The tie bars 23 are then positioned in between the right angle pieces 21 so that the openings in the tie bars 23 are in alignment with corresponding openings in the right angle pieces 21. The pins 25 are installed to fixedly attach the tie bars 23 to the lower die 15 and the wedges 27 are driven to attach the upper die 13 to the tie bars 23 and to effectively tighten the upper and lower dies together.

The assembled structure is then placed in an oven and heated to approximately 1200° F. to 1250° F. Since the tie bars 23 have a low thermal expansion and the upper and lower dies 13 and 15 have a large thermal expansion, a pressure will be applied to the diaphragm 31 causing it to be pressed against the seal bead 33 to coin a bead around the outer edge of the diaphragm 31 and form a vacuum tight seal. After a vacuum is applied to the area between the diaphragm 31 and the workpiece 29, the atmospheric pressure in the oven serves to heat form and/or flatten the workpiece 21 to the desired shape and condition.

Although the invention has been illustrated in the accompanying drawing and described in the foregoing specification in terms of a preferred embodiment thereof, the invention is not limited to this embodiment. It will be apparent to those skilled in the art that the hereinbefore described thermoclamp may be used with materials other than titanium. It would be particularly useful in the glass and plastic forming fields or on any suitable metallic alloy. Also, it should be noted that certain changes, modifications and substitutions can be made in the construction details without departing from the true spirit and scope of the appended claims.

I claim:

1. A thermoclamp for flattening and forming a sheet material workpiece in a heated oven, said thermoclamp comprising an upper die fabricated of an alloy having a large thermal expansion, a lower die fabricated of an alloy having a large thermal expansion, said upper and lower dies being of the "egg crate" type with a plurality of cross members between outer frame members thereof, the sheet material workpiece being positioned between said upper and lower dies, and a series of vertically oriented wedge activated tie bars attached between the outer edges of the upper and lower dies, said tie bars being fabricated of an alloy having a low thermal expansion, whereby the application of heat to the thermoclamp causes a differential expansion between said dies and said tie bars thereby applying pressure to the workpiece.

2. The thermoclamp defined in claim 1 wherein a diaphragm is positioned between the lower surface of the upper die and the upper surface of the workpiece, and a vacuum line is positioned to draw the air from the area between said diaphragm and said workpiece whereby the atmospheric pressure in the oven forms and flattens the heated workpiece.

3. The thermoclamp defined in claim 2 including means for sealing said diaphragm to said lower die to form a vacuum tight area, said sealing means comprising a seal bead positioned around the periphery of said lower die, the outer edges of said diaphragm being positioned between said seal bead and said upper die so that the differential expansion between said dies and said tie bars when the thermoclamp is heated causes said seal bead to press against said diaphragm to form a vacuum tight seal.

4. The thermoclamp defined in claim 3 wherein a plurality of pairs of right angle pieces are fixedly attached to the outer walls of said upper and lower dies, each of said pairs of right angle pieces being spaced apart and in alignment with correspondingly spaced right angle pieces, said tie bars being fixedly attached to said right angle pieces in the space therebetween, whereby the application of heat to the thermoclamp will cause the differential expansion to apply pressure to the workpiece between the upper and lower dies.

* * * * *